US010455897B2

(12) United States Patent
Chamberlain

(10) Patent No.: US 10,455,897 B2
(45) Date of Patent: Oct. 29, 2019

(54) METHOD OF DECORATING SHOES AND DECORATED SHOES

(71) Applicant: Karyn Chamberlain, Gardena, CA (US)

(72) Inventor: Karyn Chamberlain, Gardena, CA (US)

( * ) Notice: Subject to any disclaimer, the term of this patent is extended or adjusted under 35 U.S.C. 154(b) by 76 days.

(21) Appl. No.: 15/544,250

(22) PCT Filed: Jan. 15, 2016

(86) PCT No.: PCT/US2016/013728

§ 371 (c)(1),
(2) Date: Jul. 17, 2017

(87) PCT Pub. No.: WO2016/115540

PCT Pub. Date: Jul. 21, 2016

(65) Prior Publication Data

US 2018/0000198 A1 Jan. 4, 2018

Related U.S. Application Data

(60) Provisional application No. 62/104,050, filed on Jan. 15, 2015.

(51) Int. Cl.

| | |
|---|---|
| ***A43B 23/24*** | (2006.01) |
| ***A43B 21/42*** | (2006.01) |
| ***A43B 3/00*** | (2006.01) |
| ***A43B 13/00*** | (2006.01) |
| ***A43D 8/02*** | (2006.01) |
| ***A43D 8/22*** | (2006.01) |

(52) U.S. Cl.
CPC ..... *A43B 23/24* (2013.01); *A43B 3/0078* (2013.01); *A43B 13/00* (2013.01); *A43B 21/42* (2013.01); *A43D 8/02* (2013.01); *A43D 8/22* (2013.01)

(58) Field of Classification Search
CPC ..... A43B 23/24; A43B 1/0027; A43B 3/0078
USPC ..... 36/132
See application file for complete search history.

(56) References Cited

U.S. PATENT DOCUMENTS

| | | | | |
|---|---|---|---|---|
| 3,032,896 A * | 5/1962 | Weaver | A43B 3/24 | 36/101 |
| 3,427,020 A * | 2/1969 | Frederick | A63B 21/065 | 36/132 |
| 3,631,613 A * | 1/1972 | Brettell | A43B 3/0031 | 36/136 |
| 4,093,491 A | 6/1978 | Whelpton | | |

(Continued)

*Primary Examiner* — Ted Kavanaugh
(74) *Attorney, Agent, or Firm* — Lauson & Associates; Robert J. Lauson, Esq.

(57) ABSTRACT

A decoration for a shoe element and a method of decorating a shoe element includes the steps of cutting a substrate to correspond to the shape of the shoe element and applying decorative elements to the substrate. Openings are cut in a protective cover to align with areas where the decorative elements are applied to the substrate. The protective cover and the substrate are aligned, including aligning the openings in the protective cover with the decorative elements on the substrate. In the process, the substrate is coupled to the protective cover to form a one piece, and the one piece is coupled to the shoe element. The decoration, once installed on the shoe, includes the substrate under the protective cover with raised decorative elements appearing through the openings.

3 Claims, 11 Drawing Sheets

(56) References Cited

U.S. PATENT DOCUMENTS

| | | | | |
|---|---|---|---|---|
| 4,516,337 | A | 5/1985 | Adamik | |
| 4,891,868 | A * | 1/1990 | Watanabe | A44B 13/0017 24/691 |
| 5,566,477 | A | 10/1996 | Mathis | |
| 6,681,503 | B2 * | 1/2004 | Morle | A43B 5/02 36/133 |
| 2008/0252061 | A1 * | 10/2008 | Demmers | A43B 5/0415 280/811 |
| 2010/0299966 | A1 * | 12/2010 | Tanev | A43B 3/0078 36/132 |
| 2011/0076468 | A1 * | 3/2011 | Singer | D06Q 1/00 428/195.1 |
| 2011/0271813 | A1 | 11/2011 | Jarman-Miller | |
| 2013/0068118 | A1 | 3/2013 | Bartow | |
| 2013/0270359 | A1 | 10/2013 | Saxton | |
| 2014/0259295 | A1 * | 9/2014 | Guglielmo | A43B 23/24 2/245 |

* cited by examiner

METHOD OF DECORATING SHOES AND DECORATED SHOES

This application claims priority in PCT application number PCT/US2016/013728, filed 15 Jan. 2016, which claims the benefit of the filing date of provisional application No. 62/104,050, filed 15 Jan. 2015.

BACKGROUND

The present invention relates to shoes, more specifically, to a method of manufacturing decorative shoe elements and show elements comprising same.

Women's shoes come in a variety of colors, styles and designs. Both top and bottom portions of the shoes can vary widely in both style and design. For example, top portions of the shoes can have open or closed toes, open or closed heel; can include straps, buttons, zippers; and can be made of a variety of different materials. Similarly, bottom portions of the shoes can vary to include flat soles, platforms, heels of different widths and heights, wedges and any other shape or form that is stable enough to walk on, a pair of shoes is a vital part of a woman's wardrobe, and can often be central to her outfit. Accordingly, there is always demand for interesting, unusual and attractive shoe designs. This is especially true for shoes with wedge bottoms which are not typically decorated by shoe designers.

In addition, scarcity of new available shoe designs has increased the production costs, which the manufacturers are passing on to consumers. As a result, the price for a pair of evening shoes, which already can make a dent in an average's woman's budget, continues to rise. Accordingly, there is a need for a novel shoe design, which would offer flexibility in creating a wide variety of models without substantially increasing production costs.

Furthermore, a multitude of already existing styles of women's shoes can make it very difficult for shoe designers to create new ideas that would attract customers, and a fierce industry competition requires that the designs and decorations be changed often. As a result, shoe designers often attach little importance to the durability of their creations, and an expensive pair of shoes can end up having a very short life-span. As a result, women are often forced to buy a new pair of shoes simply because the decorations on the existing pair have started to wear out or fall off.

SUMMARY

A method of decorating a shoe element includes the steps of applying decorative elements to a substrate. The substrate is cut to correspond to the shape of the shoe element, and openings are cut in a protective cover to expose the substrate. The protective cover and the substrate are aligned. Included with aligning the protective cover and the substrate is also aligning the openings in the protective cover with the decorative elements. The substrate is coupled to the protective cover to form a one piece, and the one piece is coupled to the shoe element. Preferably, the decorative elements are raised elements on the substrate.

Clarifying the steps further, glitter ink may be applied to areas of the substrate adjacent to the decorative elements. The decorative elements may be applied to the substrate using a heat transfer process, including a clamshell heat transfer process. The decorative elements may also be applied to the substrate using a drop-off process. Cutting the substrate to correspond to the shoe element can be accomplished using die cutting. The protective cover may be a coated aluminum sheet or similar material, in which case the protective cover is preferably cut using laser cutting.

The method may also include affixing the substrate to the protective cover using an adhesive. Adhesive may also be used to apply the one piece to the shoe element. In one embodiment the openings in the protective cover are aligned with glitter ink on the substrate adjacent the decorative elements. Preferably, the decorative elements can be a variety of materials, including crystals, rhinestones, gems, nail heads, grommets, metal findings, metal eyelets, and plastic findings. Likewise, the substrate can be a variety of materials, including fabric, leather, plastic, wood and metal.

The method results in a novel decoration for a shoe element. The decoration includes a substantially flat substrate shaped to conform to the shoe element, with the substrate containing decorative elements. The substrate also includes a border around the decorative elements, and a protective cover is adhered to the substrate to form a one piece, the protective cover including openings and shaped to conform to the shoe element. The openings are aligned with the border and are adjacent each of the decorative elements, which aligns the openings with the decorative elements.

In one preferred embodiment, the border is made of glitter ink or includes glitter ink. The protective cover may be made of a coated aluminum sheet. The protective cover may also be adhered to the substrate using an adhesive. A variety of decorative elements may be used. Examples of decorative element materials include crystals, rhinestones, gems, nail heads, grommets, metal findings, metal eyelets and plastic findings among others. Also, a variety of substrate materials may be used, including fabric, leather, plastic, wood, and metal among others.

BRIEF DESCRIPTION OF THE FIGURES

The accompanying drawings, together with the specification, illustrate example embodiments of the present invention. These drawings, together with the description, serve to better explain aspects and principles of the present invention.

DESCRIPTION

Aspects of embodiments of the present invention are directed toward a method of decorating shoe elements, which provides for a novel and attractive shoe design, affords flexibility in creating a wide variety of models, and significantly improves the durability of the decorated portions of the shoes.

FIGS. 1-13 illustrate one or more aspects of a method of manufacturing a decorative cuff 100 that can be applied to an element of a shoe including, but not limited to, a wedged bottom of a shoe.

Figure 13:
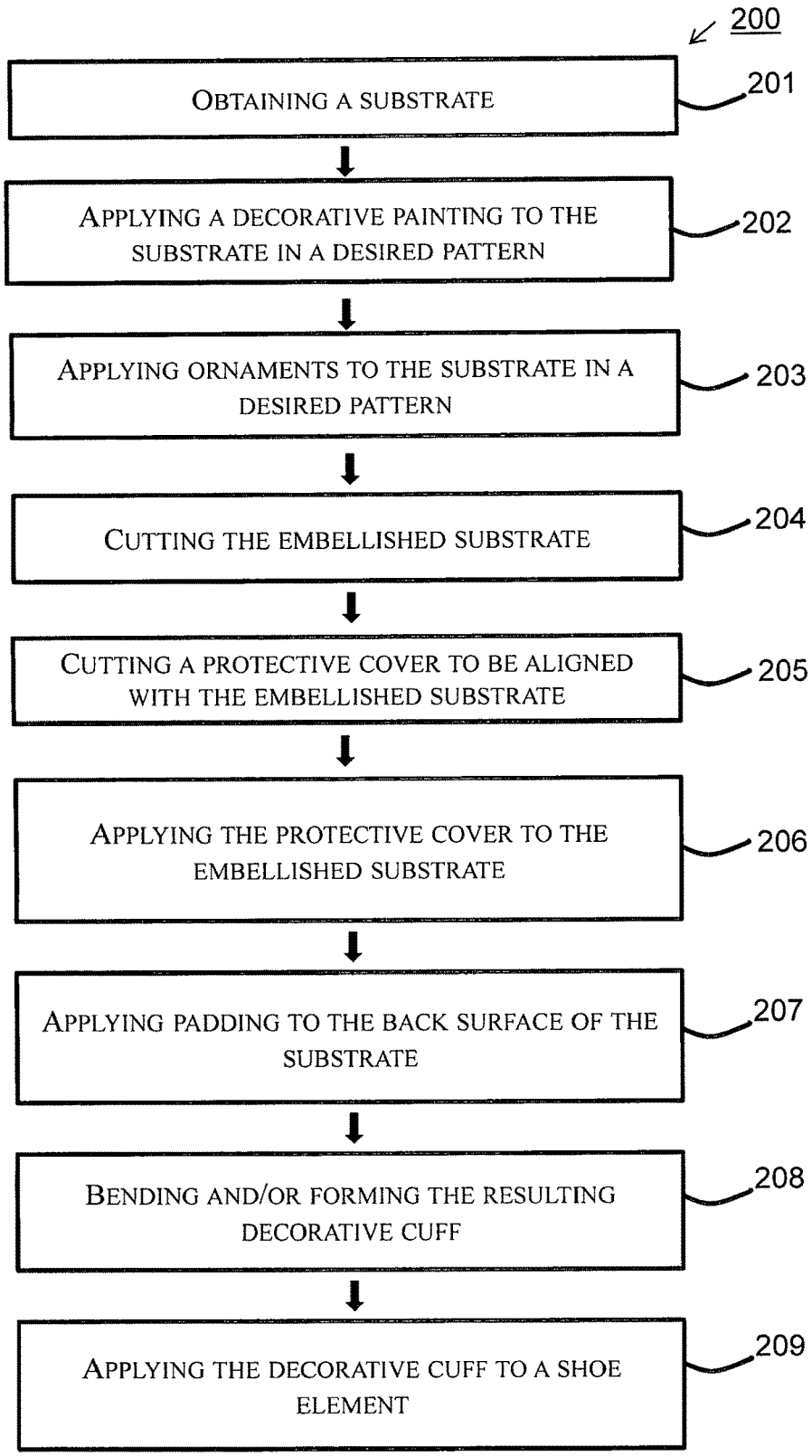
FIG. 13 is a flowchart of a process of manufacturing the decorative cuff, according to one or more embodiments of the present invention.

As shown in FIG. 13, the method of manufacturing a decorative cuff 200 may include steps including obtaining a substrate 201, applying a decorative painting to the substrate 202, applying ornaments to the substrate 203, cutting the embellished substrate 204, cutting a protective cover to be aligned with the embellished substrate 205, applying a protective cover to the substrate 206, applying padding to the back surface of the substrate 207, bending and/or forming the resulting decorative cuff 208, and applying the resulting decorative cuff to a shoe element 209.

Figure 1:
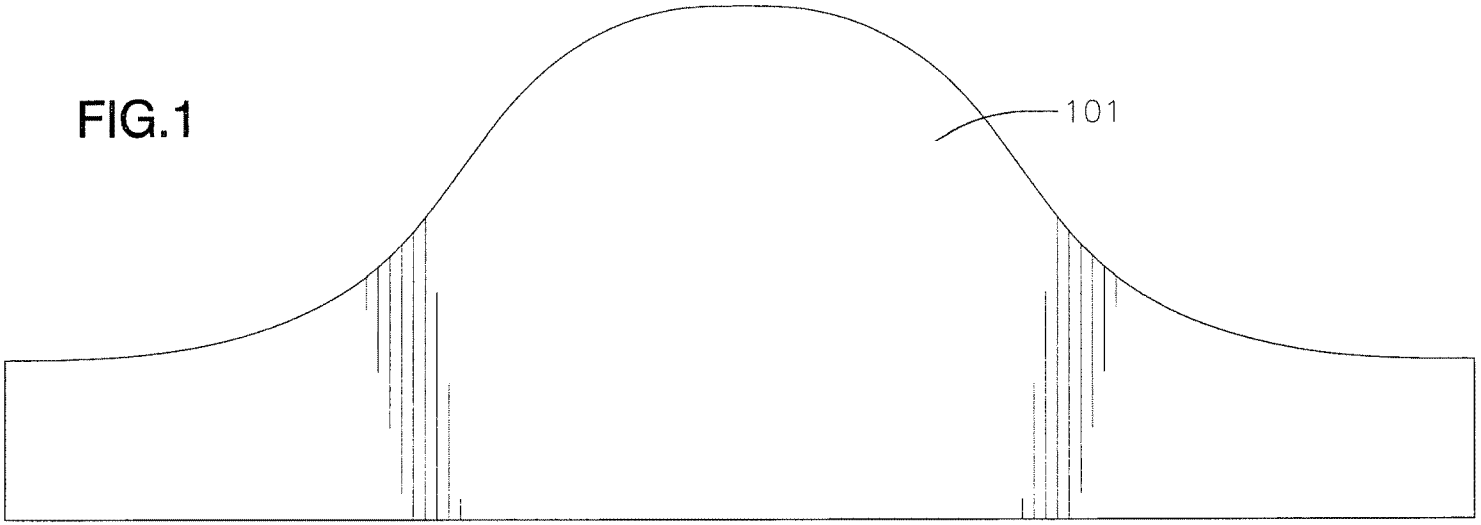
FIG. 1 is a schematic view of a substrate according to one or more embodiments of the present invention.
Figure 2:
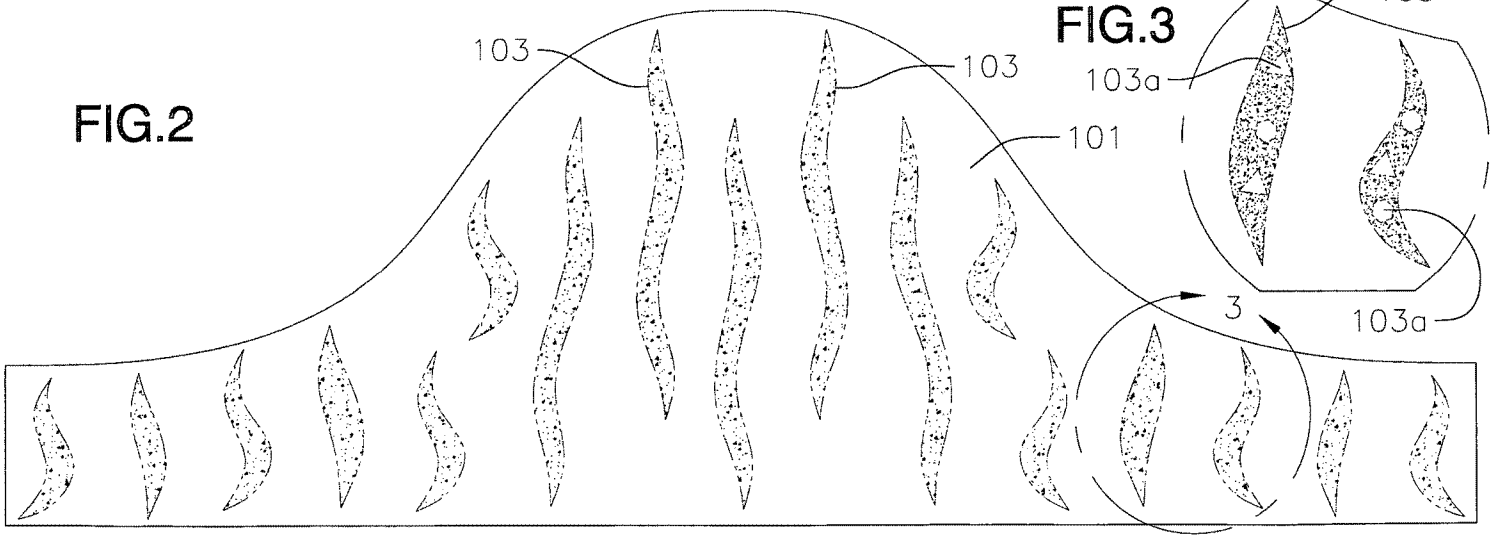
FIG. 2 is a schematic view of the substrate of FIG. 1 including a decorative painting according to one or more embodiments of the present invention.

The substrate 101 illustrated in FIG. 1 may include, but is not limited to, fabric, leather, synthetic materials, foil, etc. In some embodiments, the substrate 101 may be made of a canvas material, for example, cotton or linen canvas. Canvas is a sturdy, plain-woven fabric that can quickly absorb dye products and/or adhesives and will not be easily ripped from stretching, painting, or from applying ornaments to it. In some embodiments, the substrate 101 may include an undyed canvas, for example, of a light beige or brownish color. Alternatively, the substrate 101 can be dyed. In some embodiments, the dyed substrate may have the same or substantially the same color as the overlaying protective cover 102. When the color of the substrate 101 corresponds to the color of the protective cover 102, the substrate 101 can be overlaid with the protective cover 102, such that if the substrate 101 shows from under the protective cover 102, the substrate 101 is not visible (or substantially not visible), since the color of the substrate 101 is in harmony with the color of the protective cover 102. Alternatively, the color of the substrate 101 may be different from and/or contrasting with the color of the overlaying protective cover 102. The various color combinations of the substrate and the protective cover create a multitude of possible patterns of distinctive shapes, motifs, and designs.

However, the substrate 101 is not limited to a canvas material and may include any suitable material that is sturdy and can easily absorb adhesives. Alternatively, the substrate 101 can be a non-absorbing material that has been artificially made capable of absorbing dyes and/or adhesives through one or more suitable processes. For example, a non-absorbing material such as foil may be subjected to an appropriate surface treatment that will enable the foil material to absorb adhesive compounds. In some embodiments, the substrate 101 can be made of leather or a material similar to leather (e.g., faux leather) and having any desirable pattern including, but not limited to, a snake skin pattern. Furthermore, the substrate 101 may be etched, stitched, and/or embroidered.

Figure 2A:
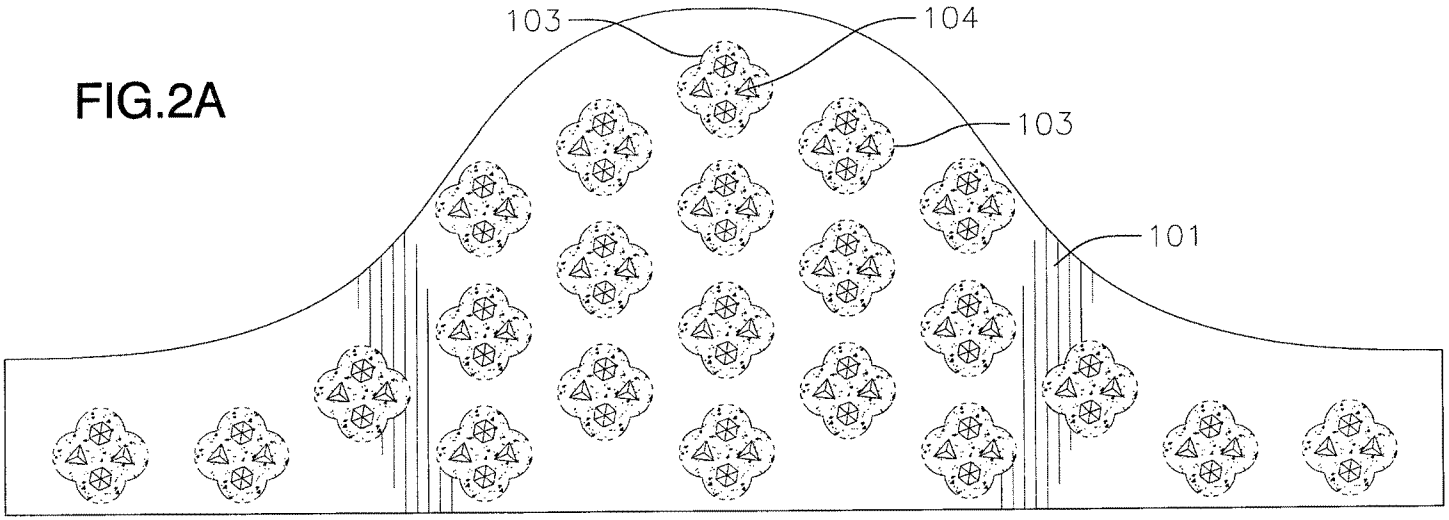
FIGS. 2A and 2B are each a schematic view of the substrate of FIG. 1 including a decorative painting according to further embodiments of the present invention.
Figure 2B:
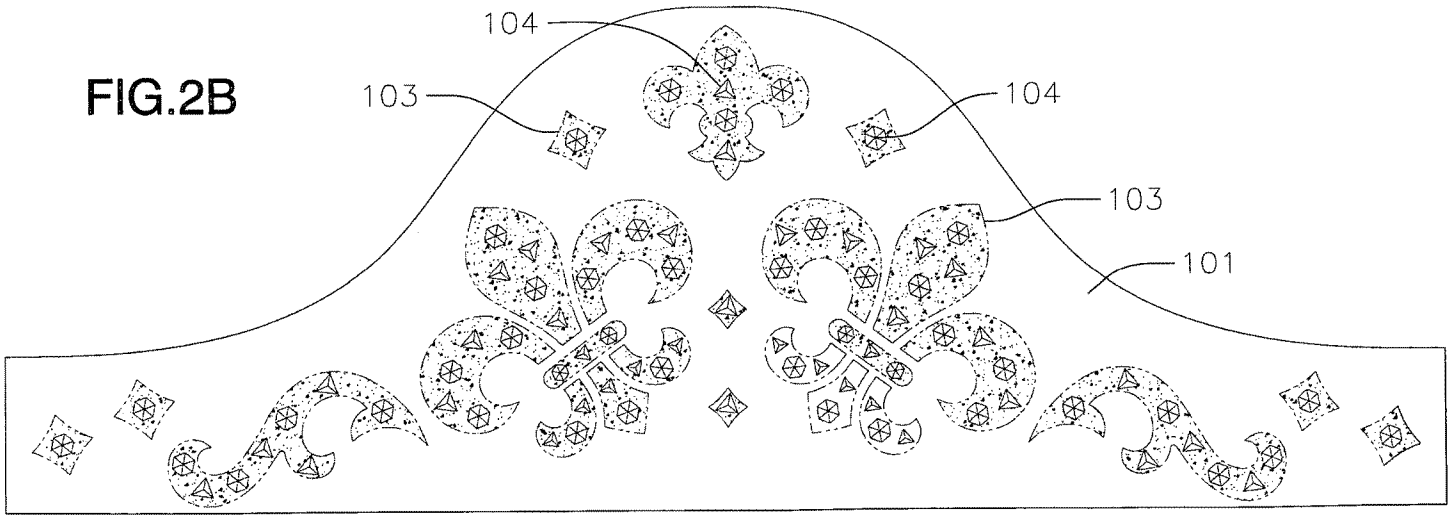

The method of manufacturing the decorative cuff 100 can further include applying a decorative painting 103 to the substrate 101 (step 202 in FIG. 13). The decorative painting 103 illustrated in FIG. 2 may be applied to the entire surface of the substrate, or may be applied only to portions of the substrate, to create a desired pattern. Non-limiting examples of the pattern may include a zebra pattern, a clover-shaped pattern, and a fleur-de-lis-shaped pattern illustrated in FIGS. 2, 2A, and 2B, respectively. However, embodiments of the present invention are not limited thereto and the decorative painting 103 may be made in any shape or design including, without limitation, circular, rectangular, triangular, lined, or star-shaped patterns. Alternatively, the decorative painting 103 may include one or more images, for example, a dragon, a city skyline, stars and stripes, etc. In some embodiments, the decorative painting 103 may include a trademark.

The decorative painting 103 may be made using glitter paint, which may further enhance the visual appeal of the decorative cuff 100. Glitter paint can be of any color, which can be the same as or different from the color of the substrate 101 and/or the protective cover 102. In some embodiments, glitter paint can be omitted.

The term "glitter paint" is not limited to paint and may include any suitable type of adhesive glitter-containing material.

When the decorative painting 103 is made using glitter paint, the glitter paint can be applied using one or more suitable methods known to those of ordinary skill in the art. For example, glitter paint may be applied manually or using any suitable mechanized process. When a mechanized process is used, the desired design for the decorative painting 103 can be first created in a CAD Drawing from a designated software program, for example, Adobe Illustrator, and the parameters can be then input into a machine applying the decorative painting to the substrate. In some embodiments, glitter paint can be applied to the substrate 101 by a so-called "drop-off" process, during which glitter paint is applied to a substrate in a predetermined pattern and is omitted in places where other elements may be attached to the substrate later, thus leaving portions of the substrate not covered by the glitter paint. However, embodiments of the present invention are not limited thereto, and any suitable method of application of glitter paint may be used. The pattern of glitter paint may correspond in shape to the decorative painting 103.

Figure 3:
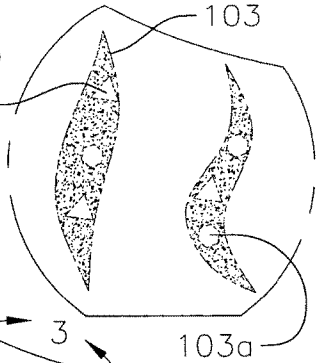
FIG. 3 is an exploded view of a portion of the decorated substrate of FIG. 2, according to one or more embodiments of the present invention.

Referring to FIG. 3, the decorative painting 103 may further include apertures 103*a*, where the decorative paint is not applied to the substrate. The apertures 103*a* may correspond to the position of ornaments, as described in more detail below.

In some embodiments, ornaments 104 may be further applied to the substrate 101 (step 203 in FIG. 13). Non-limiting examples of the ornaments 104 may include rhinestones, crystals (e.g., "Swarovski" crystals), gems, nail heads, grommets, metal finding, metal eyelets, and plastic findings. However, the ornaments 104 are not limited thereto and may include any suitable three-dimensional object that can be used as a decorative element. The ornaments 104 can be of any suitable shape and color. In some embodiments, the color of the ornaments 104 can be the same as or different from the color of the substrate 101, the decorative painting. 103, and/or the protective cover 102. In some embodiments, the ornaments 104 may include crystals, for example, "Swarovski" crystals. When the ornaments 104 include crystals, average diameter of the crystals may be of about 3 mm to about 20 mm. However, the diameter of the crystals used for the ornaments 104 is not limited thereto.

Figure 6:
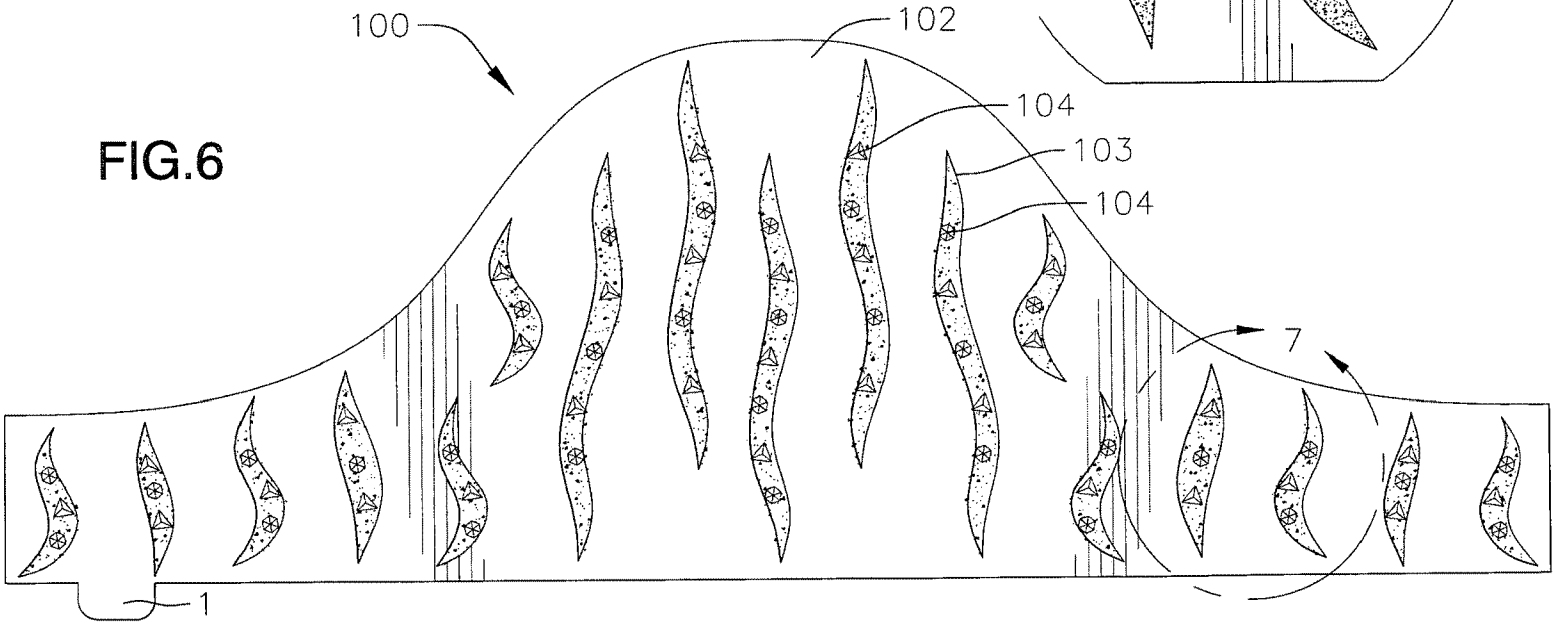
FIG. 6 is a schematic view of a completed decorative cuff of one or more embodiments of the present invention.
Figure 8:
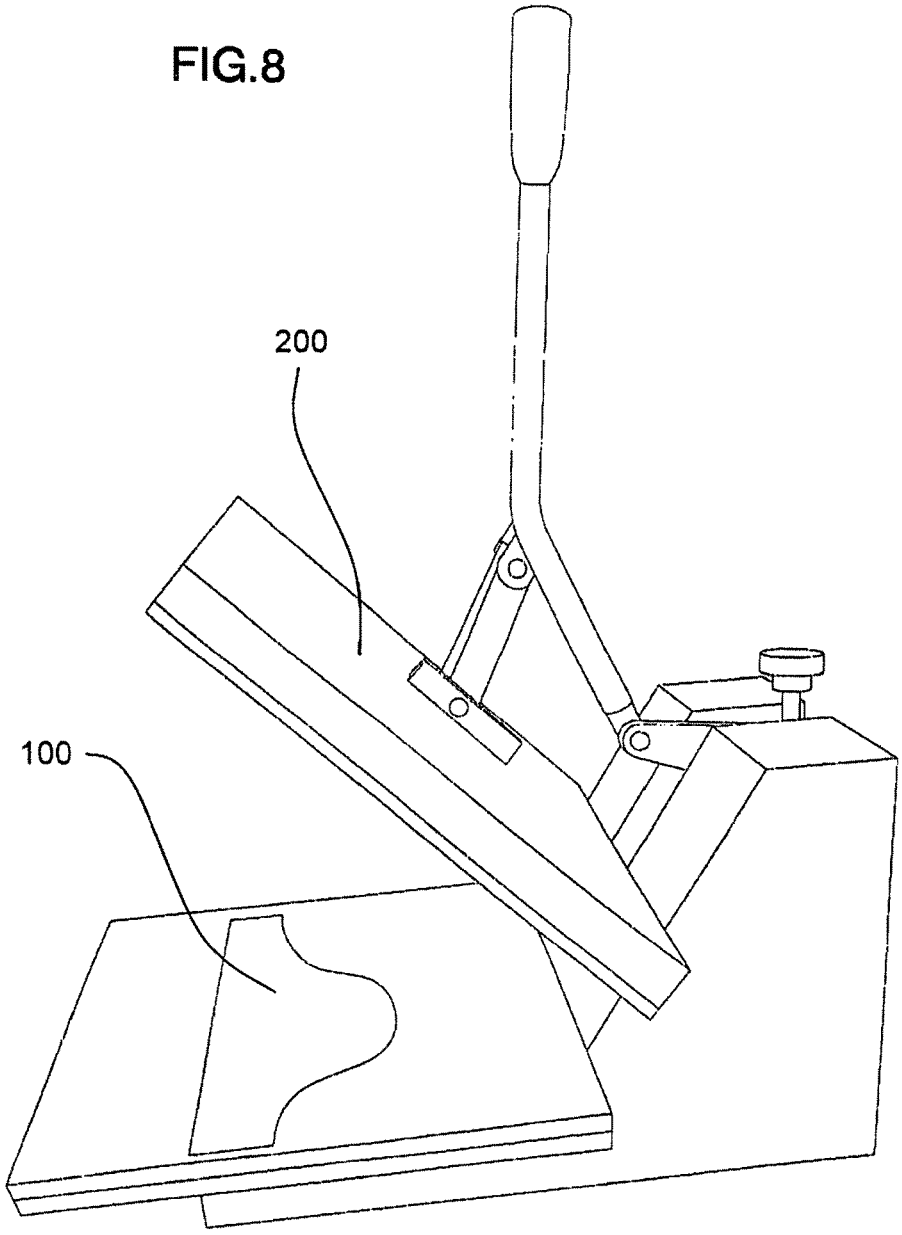
FIG. 8 is a schematic illustration of a heat transfer press, according to one or more embodiments of the present invention.

As illustrated in FIG. 6, the ornaments 104 may be positioned inside the decorative painting 103. In other words, each of the ornaments 104 may be substantially enclosed by the portions of the decorative painting 103. For example, the ornaments 104 may be positioned inside the apertures 103*a* of the decorative painting 103. However, embodiments of the present invention are not limited thereto, and the ornaments 104 may alternatively be positioned outside the decorative painting 103.

The ornaments 104 may be applied directly to the substrate 101 and may be coupled to the substrate 101. Any suitable method of application of the ornaments 104 to the substrate 101 may be used. For example, the ornaments 104 may be coupled to the substrate 101 using a heat transfer process, via an adhesive, or the ornaments may be sewn onto the substrate or set or pressed into the substrate using equipment such as grommets, eyelets, or studs. The ornaments 104 can be applied manually or using any suitable equipment or machinery.

Figure 4:
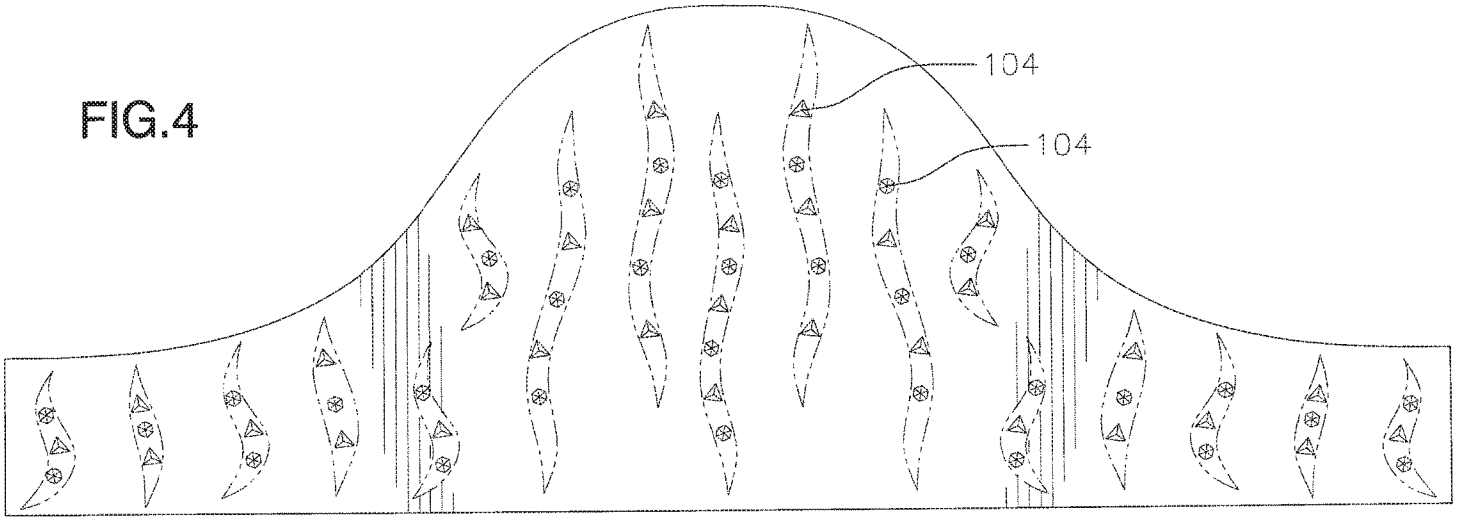
FIG. 4 is a schematic view of a heat transfer paper with pre-arranged ornaments, according to one or more embodiments of the present invention.

In some embodiments, the ornaments 104 can be applied to the substrate 101 using a heat transfer process. For example, the ornaments 104 may be positioned (or set) on a sheet of heat transfer paper, and may be applied to the substrate using, for example, a heat transfer press. Here, any suitable commercially available heat transfer paper may be used. The term "heat transfer paper" may include any suitable material that enables the transfer of an appliqué to a substrate using heat. For example, the heat transfer paper may include a heat activated adhesive made from natural rubber, synthetic or hybrid blends, based on styrene acrylic, polyurethane, vinyl acetate and/or natural emulsions. As illustrated in FIG. 4, the ornaments 104 may be arranged on the heat transfer paper to correspond to a pre-set pattern or design. Similar to the decorative painting 103, the positioning of the ornaments 104 on the heat transfer paper can be performed by a mechanized process, and the parameters for positioning the ornaments can be first created in a CAD Drawing from a designated software program and then input into an applicable machine. Alternatively, commercially available heat transfers with pre-set ornaments can be used. In some embodiments, the ornaments 104 may be arranged so as to be aligned with the positions of the apertures 103 a in the decorative painting 103. However, the arrangement of the ornaments 104 is not limited thereto, and may include any desired shape, design, or pattern. The size of the heat transfer paper is not particularly limited.

After the ornaments 104 have been arranged on a heat transfer paper, the ornaments may be transferred to the substrate using a heat transfer press. In some embodiments, a clamshell kind of heat transfer press 200 can be used (see FIG. 8), but the heat transfer press is not limited thereto and may include any suitable equipment capable of effectively transferring decorative elements onto a substrate material. In some embodiments, the application of the ornaments can be performed by placing the substrate on the bottom panel of the press, aligning the heat transfer paper with the pre-arranged ornaments over the substrate, and lowering the top panel of the press using a lever. The temperature for the transfer may be from about 300° F. to about 400° F., and the pressure may be from about 50 psi to about 200 psi. The time period inside the press may be from about 15 to about 50 seconds. However, application process and corresponding conditions may vary depending on the equipment used, and are not limited to the above-described embodiments.

Alternatively, the ornaments 104 can be applied manually, for example, via an adhesive, or by sowing the ornaments 104 to the substrate 101. However, these methods, in addition to being time-consuming, may also be less effective. In contrast, a heat transfer process is faster and allows for improved adhesion of the ornaments. Furthermore, embodiments of the present invention are not expressly limited to using a heat transfer process, and may include any suitable process for effectively and efficiently adhering decorations to a substrate.

In some embodiments, the ornaments 104 are applied directly to the surface of the substrate 101. When the ornaments 104 are applied directly to the surface of the substrate 101, the ornaments can be easily and firmly fixed to the substrate. For example, when the substrate is made of a canvas material, the substrate can easily absorb an adhesive and may allow for the ornaments to be firmly fixed to the substrate. In addition, the ornaments can be easily sewn to a canvas substrate or set or pressed into the substrate using equipment such as grommets3 eyelets, or studs. In contrast, compounds used to create the decorative painting 103 such as, for example, glitter paint, are generally not absorbing. As a result, when the ornaments are applied to the decorative painting 103 using an adhesive, the surface of the decorative painting 103 would not absorb the adhesive to the same degree as a canvas material would, and will prevent the ornaments from being firmly fixed.

Accordingly, when the decorative cuff 100 includes the ornaments 104, the decorative painting 103 can further include apertures 103*a*, corresponding to the position of the ornaments 104. The apertures 103*a* may correspond to the regions inside the decorative painting 103, where the decorative painting 103 is not applied to the substrate 101. For example, if the decorative painting 103 is made to correspond to a zebra pattern (e.g., by applying stripes of black glitter paint to a light-colored canvas substrate), the regions of the decorative painting 103 (i.e., stripes of black glitter paint) may further include apertures 103*a*, where the glitter paint is not applied to the substrate. As a result, when the ornaments 104 are positioned inside the apertures 103*a*, the ornaments 104 may be coupled directly to the surface of the substrate 101. This allows for the ornaments 104 to be firmly fixed to the substrate 101, and prevents or substantially reduces the possibility of the ornaments 104 falling off the decorative cuff 100. As a result, the "life-span" of the shoes using the decorative cuff 100 can be increased.

Figure 12:
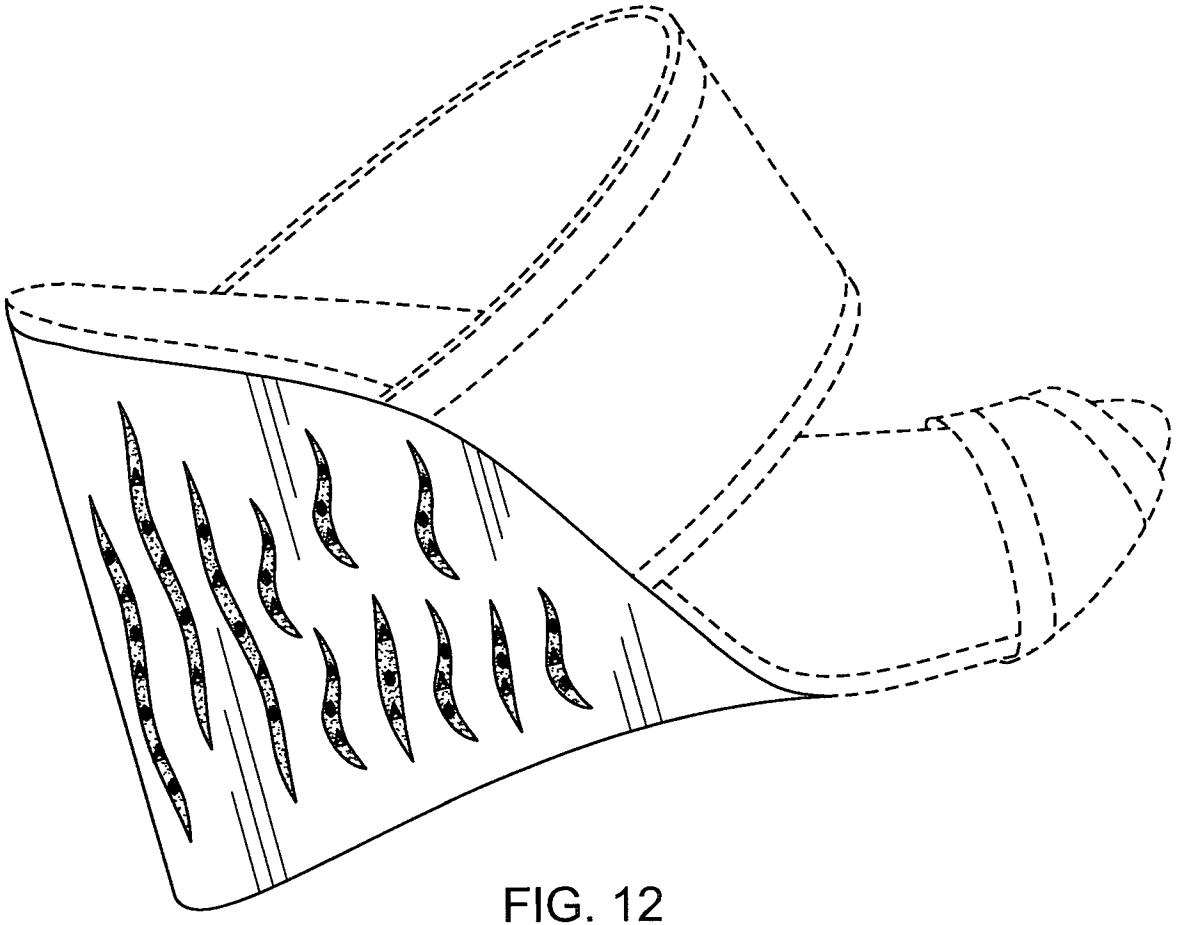
FIG. 12 is a side view of a decorative cuff according to one or more embodiments of the present invention attached to a shoe.

Next, the adorned substrate 101 can be cut to fit the shape of a shoe element to which the decorative cuff would later be applied (step 204 in FIG. 13). In some embodiments, the substrate may be cut such that when the resulting decorative cuff is wrapped around the shoe element, either the entire outer surface of the shoe element is covered by the cuff, as illustrated in FIG. 12, or portions of the surface of the shoe element are covered by the cuff. For example, when the shoe element is a wedge (i.e., a wedged heel), the substrate may be cut to have the shape as illustrated in the drawings. However, the provided drawings should be understood to be schematic representations of the final product, and the shape of the decorative cuff may vary depending on the shape and size of the corresponding shoe element In some embodiments, the substrate may be cut using die-cutting, but the method of cutting the substrate is not limited thereto and may include any suitable hand cutting or machine cutting method. When a machine cutting method is employed, a CAD drawing from a designated software program may be used to input the parameters for cutting the substrate into a machine performing the process.

The decorative cuff 100 may further include a protective cover 102. The protective cover 102 may be cut to a desired shape and may be positioned on and adhered to the substrate 101 (steps 205 and 206 in FIG. 13). In some embodiments, the protective cover 102 may be in a form of a sheet having the shape that substantially corresponds to the shape of the substrate. In some embodiments, the protective cover 102 may be made of a metal or a metal alloy. Non-limiting examples of the metal and/or the metal alloy may include ferrous metals and metal alloys, for example, cold rolled mild carbon steel sheet having commercial grade of 28 gauge or 30 gauge and decimal of 0.010, 0.015 or 0.020, and non-ferrous metals and metal alloys such as aluminum, copper, tin, brass, bronze, and aluminum alloys. However, the protective cover 102 is not limited thereto and may include any suitable material that can be bent without breaking, but that is also sturdy and can hold its shape. In some embodiments, the protective cover 102 can be made of rubber, vinyl, a plastic material such as, for example, ethyl vinyl acetate (EVA), or of metals laminated using one or more of rubber, vinyl, and Mylar® polyester film.

Figure 5:
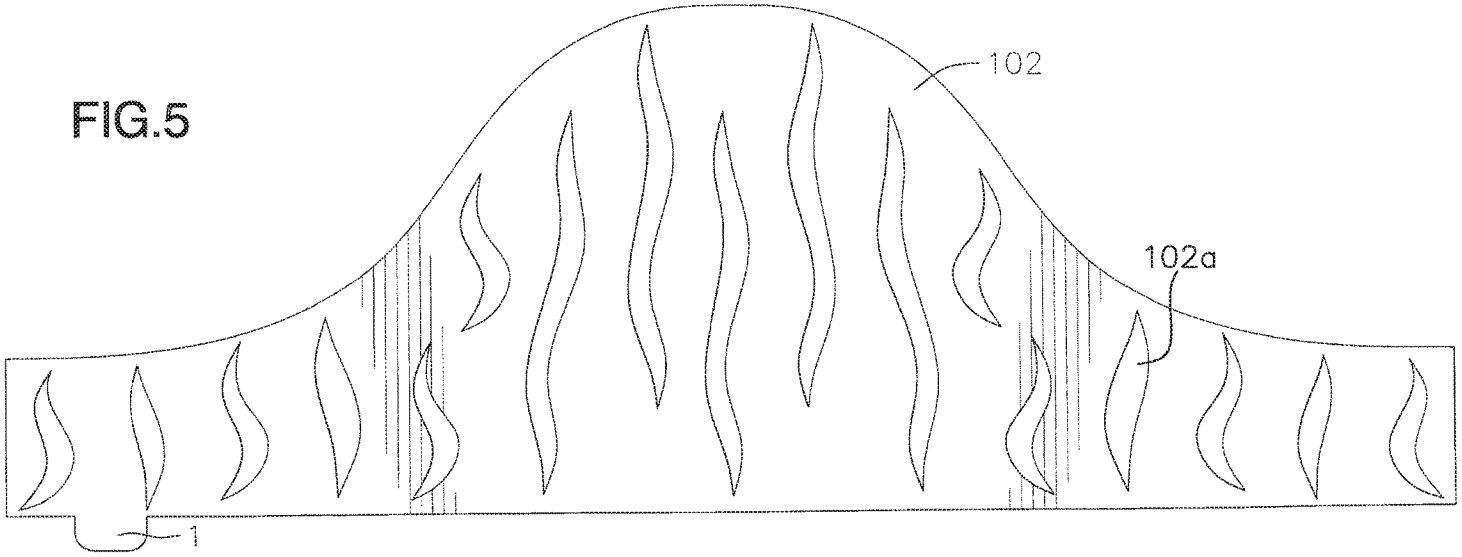
FIG. 5 is a schematic view of a protective cover according to one non-limiting embodiment of the present disclosure.
Figure 5A:
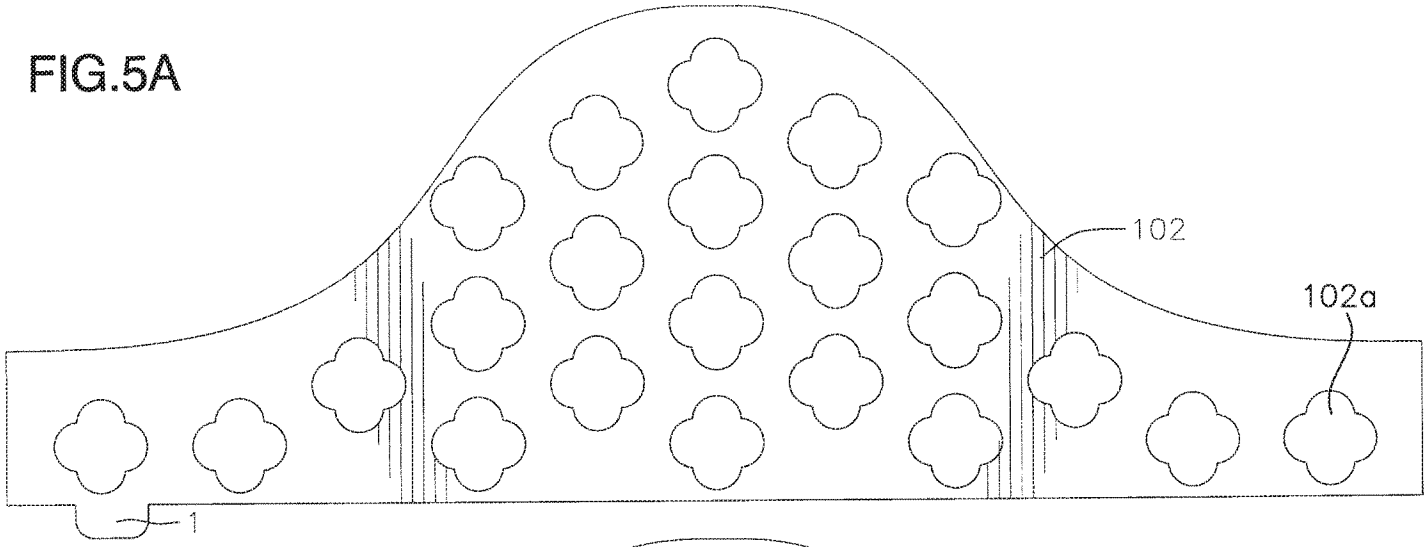
FIGS. 5A and 5B are each a schematic view of a protective cover according to further embodiments of the present invention.
Figure 5B:
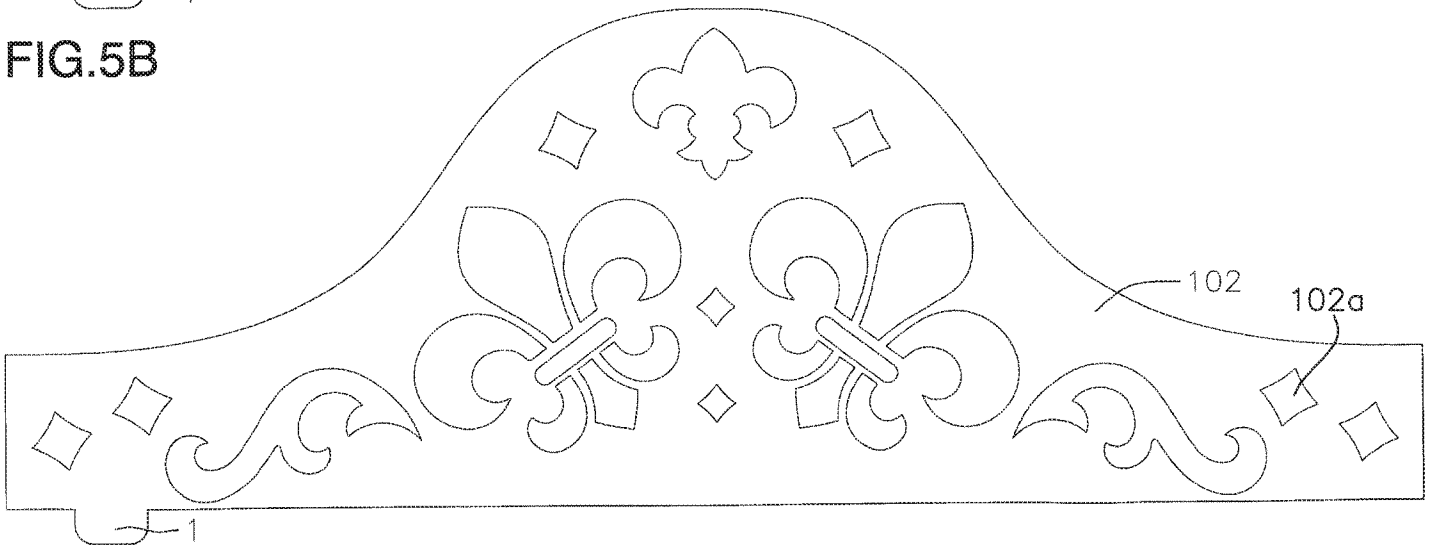

In some embodiments, the protective cover 102 may include openings 102*a*, as illustrated in FIGS. 5, 5A, and 5B. The openings 102*a* may correspond to the shape of the decorative painting 103, such that when the protective cover 102 is positioned over the substrate 101, the decorative painting 103 on the substrate 101 can be visible through the openings 102*a* in the protective cover 102. Accordingly, similar to the decorative painting 103, the openings 102*a* in the protective cover 102 may be of any suitable shape, design, and/or pattern. In embodiments where the substrate does not include a decorative painting 103, the openings 102*a* may be of any desired shape and may reveal the substrate underneath the protective cover.

The protective cover 102, including the openings 102*a*, may be cut using any suitable process known to those of ordinary skill in the art, including, but not limited to, laser cutting, water jet cutting, and/or plasma cutting. For example, a CAD Drawing from a designated software program may be used to input the parameters for cutting the protective cover 102 into a machine performing one or more of the above-referenced processes. In some embodiments, the machine may use a DXF type file, but is not limited thereto.

Figure 7:
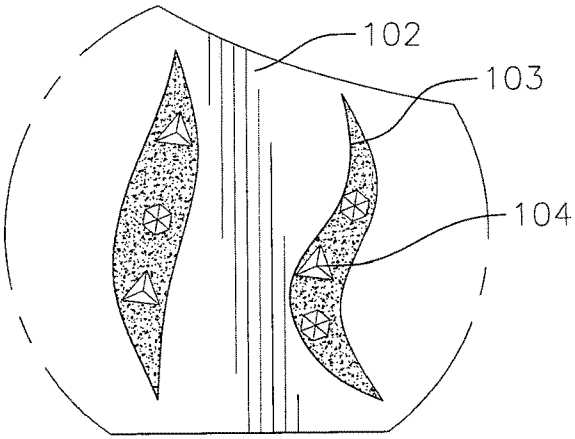
FIG. 7 is an exploded view of a portion of the decorative cuff of FIG. 6.
Figure 9:
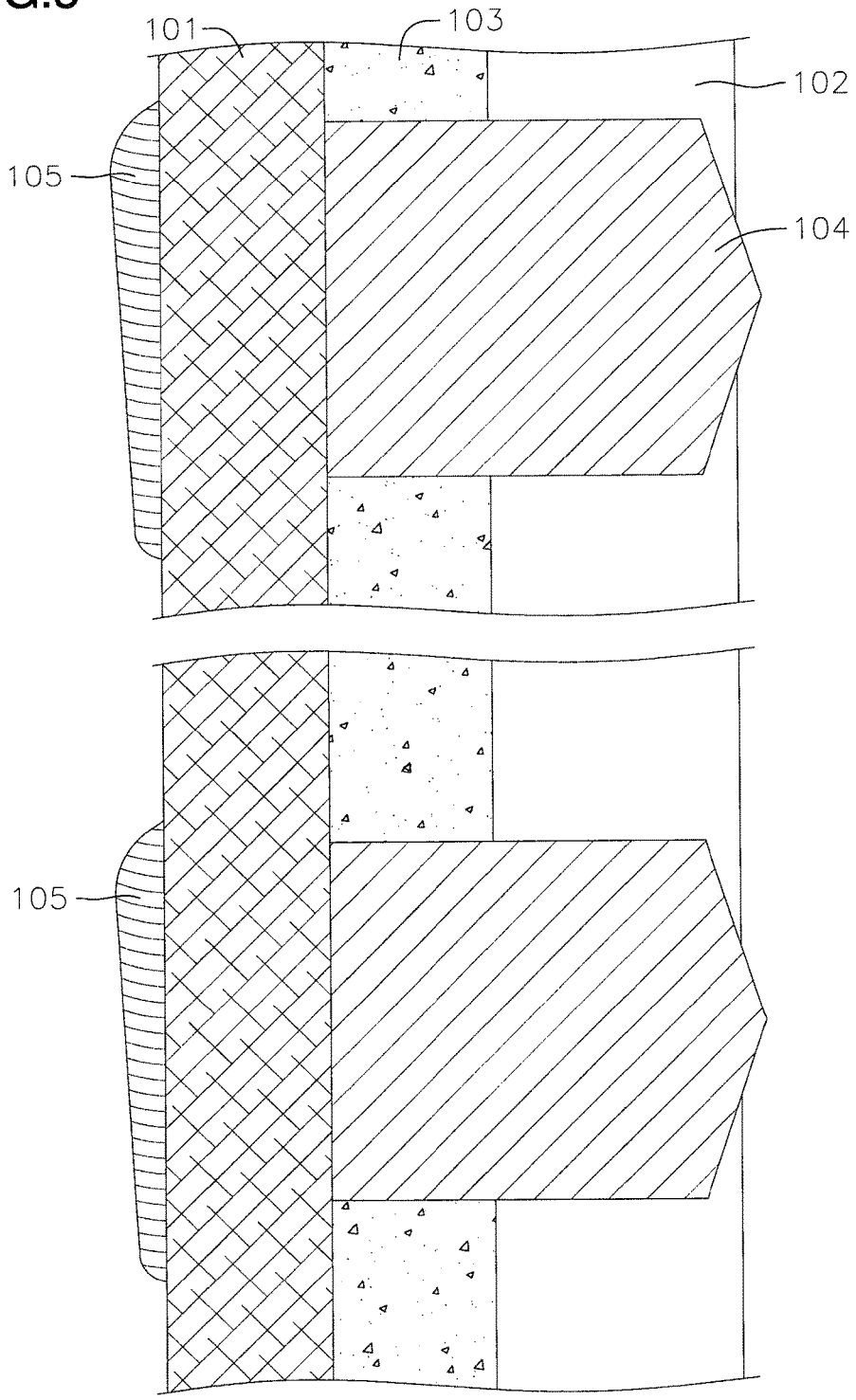
FIG. 9 is a cross-sectional schematic view of the decorative cuff of FIG. 6.

A thickness of the protective cover 102 may less than or equal to about 0.025 inch, for example, from about 0.025 to about 0.250 inch. For example, the thickness of the protective cover 102 may be the same or substantially the same as the thickness of the decorative elements on the substrate 101. Accordingly, when the substrate 101 is overlaid with the protective cover 102 as illustrated in FIGS. 7 and 9, the decorative elements on the substrate 101, including the decorative painting 103 and the ornaments 104, may be "nested" inside the openings of the protective cover 102, and may not substantially protrude outside the protective cover 102. As a result, the possibility of damage to the decorative elements can be prevented or reduced, and a "life-span" of the shoes using the decorative cuff can be increased.

When the protective cover 102 is a metal or a metal alloy sheet, an outer surface of the protective cover 102 can be subjected to one or more processes designed to improve its durability. For example, the protective cover 102 can be plated with one or more of nickel, silver, brass, and gold using one or more plating processes commonly known to those of skill in the art. Alternatively, the protective cover 102 can be anodized using one or more anodizing processes commonly known to those of skill in the art. When the protective cover 102 is made of aluminum or aluminum alloy, the protective cover 102 can be both plated and anodized. As a result, the protective cover 102 will have improved scratch and corrosion resistance, and will greatly increase the durability of the bottom portion of the shoe that is usually vulnerable to wear and tear.

In addition to increasing the durability of the protective cover 102, one or more of the above-described processes can be used to enhance the aesthetic appeal of the protective cover. For example, the protective cover 102 can be plated with a coat of gold or silver-colored metal, though the color of the metal used for plating is not limited thereto. In embodiments where the protective cover 102 is made of aluminum or aluminum alloy, one or more colors can be applied to the protective cover 102 during the anodizing process. Alternatively, color sublimation can be used to blend two or more colors on the surface of the protective cover 102. Color sublimation can be done by, for example, inkjet sublimation or laser sublimation, but is not limited thereto. In embodiments where the protective cover 102 is made of a ferrous metal or metal alloy, physical vapor deposition process (PVD) can be used in lieu of plating. In some embodiments, the protective cover 102 can include dyed or tinted metal. Each of the above-described processes should be apparent to those of ordinary skill in the art, and detailed descriptions thereof will not be provided. In addition, these processes are provided as examples and are not intended for purposes of limitation. Accordingly, the protective cover 102 can be subjected to any suitable finishing process commonly used in metalworking.

In some embodiments, the protective cover 102 may include one or more tabs 1 extending from the cover, as illustrated in FIGS. 5-6. The tabs 1 may be strategically positioned to indicate whether the resulting decorative cuff 100 should be applied to a right or a left shoe. For example, at least one tab may be placed on the edge of the protective cover that would be positioned on the inner side of the left shoe. The presence of the tabs can be especially important if the decorative cuff for the left shoe is different from the decorative cuff for the right shoe, as in the case of wedged shoes, for example. Accordingly, the possibility of error during the application of the completed decorative cuff to the shoe element can be prevented or reduced, thus improving the efficiency of the application process and reducing the overall cost.

The protective cover 102 may be applied to the substrate 101 using any suitable process including, but not limiting to, using an adhesive. During the application, the protective cover 102 may be positioned over the substrate 101, with an adhesive layer therebetween, such that the openings 102*a* of the protective cover 102 are aligned with the regions of the substrate 101 to which the decorative painting 103 and/or the ornaments 104 have been applied. In other words, if the substrate includes any decorative elements, the protective cover 102 may be adhered directly to the portions of the substrate 101 not covered by the decorative elements. For example, if the substrate 101 is a canvas substrate, the protective cover 102 can be adhered directly to the canvas surface. As a result, the adhesive may be properly absorbed by the canvas, and the protective cover 102 may be firmly fixed to the substrate 101.

Any suitable adhesive be used to couple the protective cover 102 to the substrate 101. In some embodiments, E-6000® (commercially available at most art stores) can be used, but the adhesive is not limited thereto, and may include any suitable adhesive including epoxy adhesives such as epoxy resins, heat activated adhesives made from natural rubber, synthetic or hybrid blends, based on styrene acrylic, polyurethane, vinyl acetate and/or natural emulsions, or any combinations thereof. A thickness of the adhesive layer can be from about 1 to about 10 mm, but is not limited thereto, so long as the adhesive layer can provide sufficient bonding. In some embodiments, the adhesive layer is applied to the substrate 101, but may alternatively be applied to an inner surface of the protective cover 102. When the adhesive is applied to the substrate, it may be applied only to the portions of the substrate not covered by the decorative painting 103 and/or the ornaments 104.

The substrate 101 and the protective cover 102 may be pressed together, with the adhesive layer therebetween, for several minutes or until the materials are properly bonded to each other. In some embodiments, the adhesive can be cured for about two minutes before the substrate 101 and the protective cover 102 are joined together. After the substrate 101 and the protective cover 102 are joined together, the adhesive can also be further cured using any suitable curing process known to those of ordinary skill in the art.

To further improve bonding strength between the substrate 101 and the protective cover 102, the inner surface of the protective cover 102 can be sanded, before it is coupled to the substrate 101. In some embodiments, sand paper having medium to medium/high grit (for example, 60 or 80 grit) may be used, but is not limited thereto. When the inner surface of the protective cover 102 is sanded, the protective cover 102 can better absorb the adhesive, and thus may be more firmly fixed to the substrate 101.

After the protective cover 102 has been coupled to the substrate 101, the resulting decorative cuff 100 is bent to correspond to the shape of the shoe element (step 208 in FIG. 13), and then coupled to the shoe element (step 209 in FIG. 13). The process for adhering the decorative cuff 100 to the shoe element may be substantially similar to the process used to attach the protective cover 102 to the substrate 101, except that here, the adhesive may be applied to a bottom surface of the substrate 101, opposite from the surface of the substrate overlaid with the protective cover 102.

Figure 11:
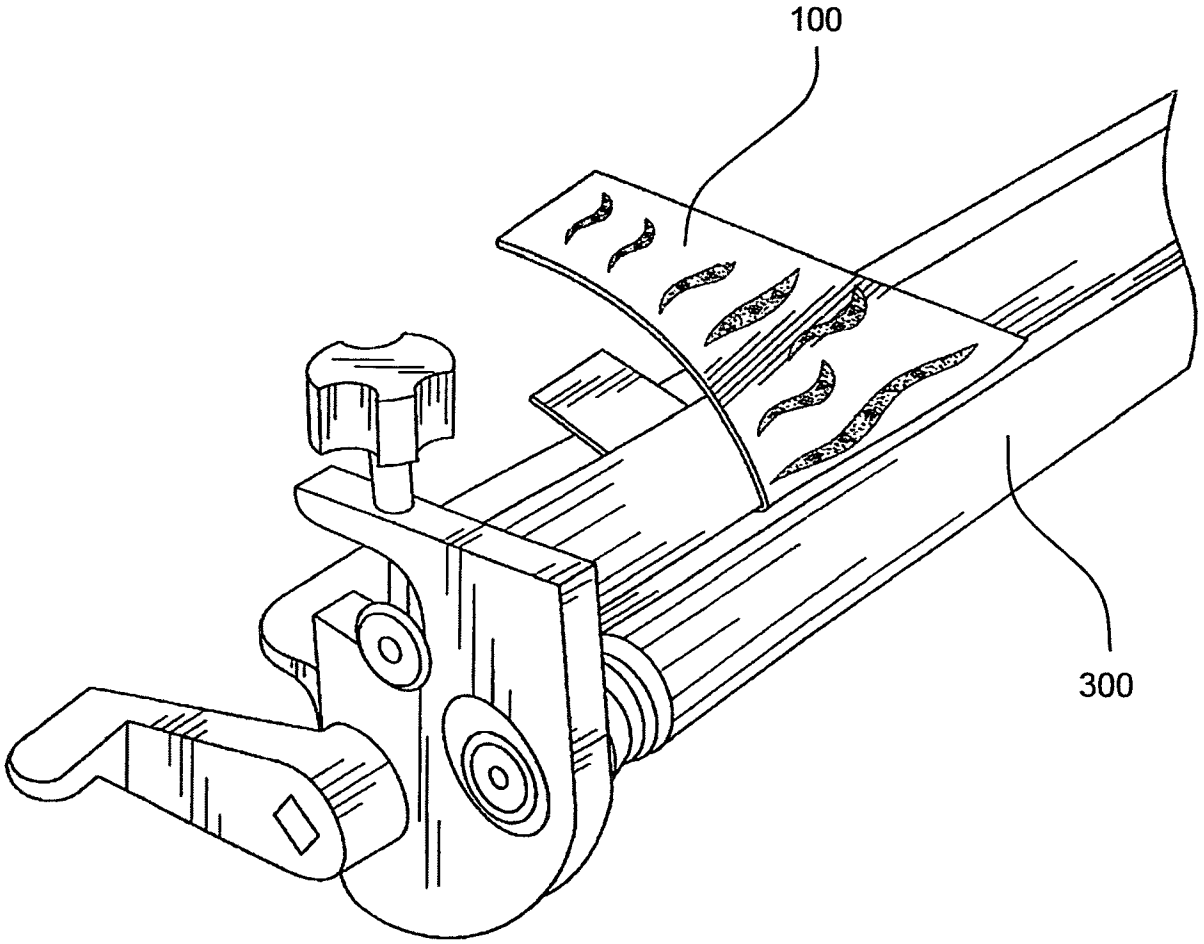
FIG. 11 is a schematic perspective view illustrating a portion of a slip roller with the decorative cuff inside the slip roller, according to one or more embodiments of the present invention.

In order to bend the decorative cuff 100, it may be first passed through a slip roller or any other bending and/or forming equipment 300, as illustrated in FIG. 11. Using such bending and/or forming equipment allows for safely and accurately bending the decorative cuff to fit the shape of the shoe element. When the decorative cuff 100 is applied to a wedged shoe element, the bending and/or forming equipment will help create the necessary radii and contours in the decorative cuff, which would not otherwise be attainable. Accordingly, the decorative cuff can be easily and firmly fit over the shoe element.

Figure 10:
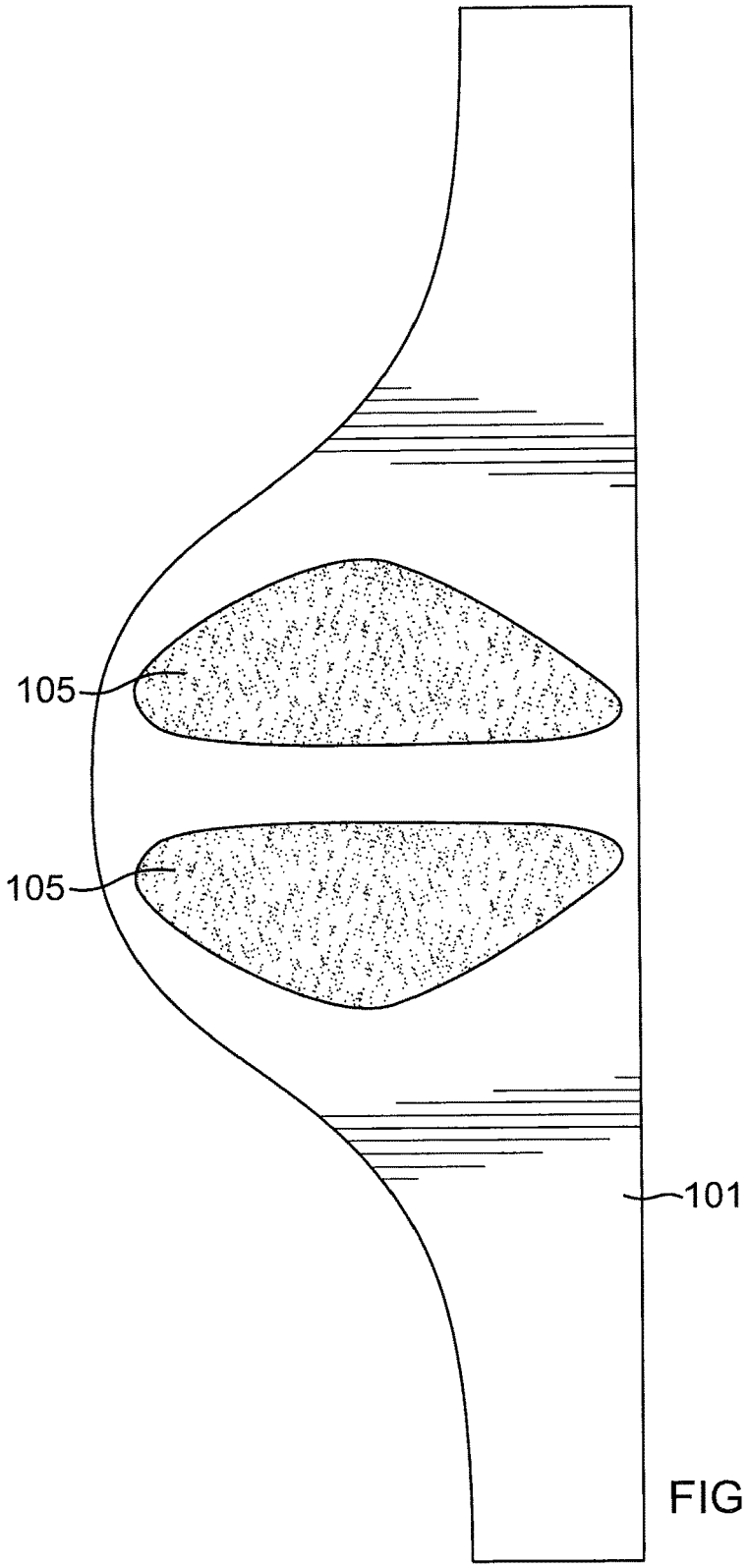
FIG. 10 is a schematic view of a bottom surface of the substrate including padding, in accordance with one or more embodiments of the present invention.

In some embodiments, before the decorative cuff 100 is bent and attached to a shoe element, a padding 105 may adhered to the bottom surface of the substrate 101, as illustrated in FIGS. 9 and 10 (step 207 in FIG. 13). The padding 105 may improve how smoothly and evenly the decorative cuff can be adhered to the shoe element and may eliminate, or at least substantially reduce, the appearance of air pockets, bubbles, creases, and/or other imperfections. In some embodiments, the padding 105 may be made of felt, such as the one available in art stores, or filler of silicone. However, the padding 105 is not limited thereto and may include any suitable material. The padding 105 may be applied to the substrate 101 using, for example, an adhesion process as described above in connection with the substrate 101 and the protective cover 102. In some embodiments, the padding 105 may cover from about ⅛to about ⅔of the surface of the substrate 101. However, position of the padding 105 on the surface of the substrate 101 is not limited, and may encompass any strategic positioning that allows for the decorative cuff 100 to be evenly adhered to the shoe element.

After the completed decorative cuff 100 has been applied to the shoe element, the top portion of the shoe may be completed by the manufacturer in accordance with the desired design. As a result, a wide variety of shoe models can be manufactured without a substantial increase in production costs of each model. FIG. 12 is a schematic image of a completed shoe, where dotted lines illustrate an example of a possible design of a top portion of the shoe.

While the present invention has been described in connection with certain example embodiments, it is to be understood that the invention is not limited to the disclosed embodiments, but, on the contrary, is intended to cover various modifications and equivalent arrangements included within the spirit and scope of the present disclosure.

What is claimed is:

1. A method of decorating a shoe element, the method comprising:

applying decorative elements to a substrate using heat transfer process;

applying glitter ink to areas of the substrate adjacent to the decorative elements;

cutting the substrate to correspond to the shoe element using die cutting;

cutting openings in a coated aluminum sheet using laser cutting;

coupling the die cut substrate to the laser cut coated aluminum sheet via an adhesive to obtain a one piece, such that the openings in the coated aluminum sheet are aligned with the areas of the substrate comprising the decorative elements and the glitter ink;

applying the one piece to the shoe element via an adhesive;

wherein the decorative elements comprise at least one selected from the group consisting of crystals, rhinestones, gems, nail heads, grommets; metal findings, metal eyelets and plastic findings; and wherein the substrate comprises at least one selected from the group consisting of fabric, leather, plastic, wood and metal.

2. The method of claim 1 further comprising the step of applying the decorative elements to the substrate using a drop-off process.

3. The method of claim 1 wherein the heat transfer process is a clamshell heat transfer process.

* * * * *